US010100449B2

(12) United States Patent
Schwarzberger et al.

(10) Patent No.: US 10,100,449 B2
(45) Date of Patent: Oct. 16, 2018

(54) METHOD, APPARATUS, AND COMPUTER-READABLE MEDIUM FOR STITCHING

(71) Applicant: ABM International, Inc., The Woodlands, TX (US)

(72) Inventors: Neal A. Schwarzberger, The Woodlands, TX (US); William E. Schnaufer, Rochester, NY (US)

(73) Assignee: ABM International, Inc., The Woodlands, TX (US)

( * ) Notice: Subject to any disclaimer, the term of this patent is extended or adjusted under 35 U.S.C. 154(b) by 0 days.

(21) Appl. No.: 15/803,021

(22) Filed: Nov. 3, 2017

(65) Prior Publication Data

US 2018/0051406 A1 Feb. 22, 2018

Related U.S. Application Data

(63) Continuation of application No. 14/205,641, filed on Mar. 12, 2014, now Pat. No. 9,840,797.

(51) Int. Cl.
*D05B 19/14* (2006.01)
*D05B 11/00* (2006.01)

(52) U.S. Cl.
CPC ..... *D05B 19/14* (2013.01); *D05B 11/00* (2013.01)

(58) Field of Classification Search
CPC ..... D05B 11/00; D05B 19/14
USPC ..... 700/136, 137, 138
See application file for complete search history.

(56) References Cited

U.S. PATENT DOCUMENTS 4,548,143 A * 10/1985 Martell ..... D05B 69/20 112/275
4,584,954 A * 4/1986 Soyama ..... D05B 69/24 112/275
4,658,741 A * 4/1987 Jehle ..... D05B 35/102 112/131
4,765,265 A * 8/1988 Brownbill ..... D05C 7/08 112/88
4,807,546 A * 2/1989 Lenson ..... B65C 5/00 112/104

(Continued)

FOREIGN PATENT DOCUMENTS

JP 2002292175 A 10/2001

OTHER PUBLICATIONS

PantoiVision: Innova Innovative Quilting Systems website dated Nov. 30, 2012, http://innovalongarm.com/index.php?option+com_content . . . (2 pages).

*Primary Examiner* — Danny Worrell
(74) *Attorney, Agent, or Firm* — Timothy W. Menasco, Esq.; Harter Secrest & Emery LLP

(57) ABSTRACT

Presented are a method, apparatus, and computer-readable medium for stitching. The method includes sensing, by a first sensor, a movement of a work piece relative to a sewing head. The method further includes sensing, by a second sensor, a movement of the work piece relative to the sewing head. The method includes determining, by a processor, a translational and rotational movement of the work piece relative to the sewing head based on the sensed movement of the first sensor and the second sensor. The method also includes altering, by the processor, a speed of a reciprocating needle in response to the determined translational and rotational movement.

9 Claims, 5 Drawing Sheets

(56) References Cited

U.S. PATENT DOCUMENTS 5,562,057 A * 10/1996 Lenson ..... D05B 3/12 112/113
5,755,168 A * 5/1998 Gunther ..... D05C 7/08 112/113
6,450,110 B1 * 9/2002 Bruhl ..... D05B 19/12 112/275
6,470,813 B2 * 10/2002 Ebata ..... D05B 19/14 112/102.5
6,871,606 B2 * 3/2005 Schweizer ..... D05B 19/16 112/102.5
6,883,446 B2 * 4/2005 Koerner ..... D05B 19/14 112/272
6,959,657 B1 * 11/2005 Duval ..... D05B 19/14 112/272
7,082,884 B2 * 8/2006 Tajima ..... D05B 3/22 112/113
7,293,512 B2 * 11/2007 Tajima ..... D05C 7/08 112/106
7,325,502 B2 * 2/2008 Konig ..... D05B 19/14 112/272
7,334,533 B2 * 2/2008 Tajima ..... D05C 7/08 112/113
7,370,590 B2 * 5/2008 Tajima ..... D05B 3/22 112/113
7,373,891 B2 * 5/2008 Koerner ..... D05B 11/00 112/103
7,934,461 B2 * 5/2011 Tajima ..... D05C 7/08 112/113
8,074,590 B2 * 12/2011 Bentley ..... D05B 11/00 112/470.01
8,082,866 B2 * 12/2011 Hirose ..... D05B 19/16 112/470.03
8,186,290 B2 * 5/2012 Makino ..... D05B 19/16 112/470.13
8,904,947 B2 * 12/2014 Nishimura ..... D05B 19/12 112/470.06
9,010,259 B2 * 4/2015 Schwarzberger ..... D05B 11/00 112/117
9,115,451 B2 * 8/2015 Konzak ..... D05B 21/00
9,315,933 B1 * 4/2016 Martelli ..... D05B 19/14
9,394,640 B2 * 7/2016 Bentley ..... D05B 19/12
2002/0083873 A1 * 7/2002 Sano ..... D05B 21/00 112/102.5
2005/0066866 A1 * 3/2005 Pederzini ..... D05C 7/00 112/80.3
2005/0145149 A1 * 7/2005 Hooke ..... D05B 11/00 112/315
2006/0191452 A1 * 8/2006 Jo ..... D05B 3/22 112/113
2007/0119357 A1 * 5/2007 Tajima ..... D05C 7/08 112/104
2007/0193488 A1 * 8/2007 Tajima ..... D05B 3/22 112/88
2008/0078313 A1 * 4/2008 Hamajima ..... D05B 11/00 112/117
2010/0313806 A1 * 12/2010 Konig ..... D05B 3/22 112/475.01
2011/0290167 A1 * 12/2011 Li ..... D05B 35/06 112/113
2013/0233217 A1 * 9/2013 Shimizu ..... D05B 19/12 112/102.5
2013/0233219 A1 * 9/2013 Nakamura ..... D05B 19/12 112/470.06

* cited by examiner

METHOD, APPARATUS, AND COMPUTER-READABLE MEDIUM FOR STITCHING

FIELD OF THE INVENTION

Exemplary embodiments of the present disclosure relate to a method, apparatus and computer-readable medium for sensing movement. The present disclosure relates more specifically to sensing movement of a work piece relative to a sewing head or a sewing head relative to a work piece.

BACKGROUND OF THE INVENTION

Machine quilting is quilting made through the use of a sewing machine to stitch in rows or patterns using select techniques to stitch through layers of fabric and batting in the manner of old-style hand-quilting.

Free motion quilting is a process used to stitch the layers of a quilt together using a domestic sewing machine. The operator controls the stitch length as well as the direction of the stitching line by moving the quilt with their hands. The stitching can be made in any direction to produce curvilinear lines or straight patterns. Each design, whether drawn on the quilt top or held in the imagination of the quilter, is formed with a line of stitching that is guided by the movement of the quilt under the machine needle. The length of each stitch is determined by the distance the quilt has been moved since the previous stitch.

Machine quilting is the process of using a home sewing machine or a long arm machine to sew the layers together. With the home sewing machine, the layers are tacked together before quilting. This involves laying the top, batting, and backing out on a flat surface and either pinning (using large safety pins) or tacking the layers together. Longarm Quilting involves placing the layers to be quilted on a special frame. The frame has bars on which the layers are rolled, keeping these together without the need for tacking or pinning. These frames are used with a sewing machine mounted on a moveable platform. The platform rides along tracks so that the sewing machine can move across the layers on the frame. In contrast, a sit down quilting machine provides a stationary sewing machine attached to a flat surface for retaining a work piece. The user moves the work piece underneath the needle of the stationary sewing head of the quilting machine while operating a foot pedal that controls a reciprocating needle that creates a desired quilt or pattern.

SUMMARY OF THE INVENTION

In view of the foregoing, it is an object of the present disclosure to provide a method, apparatus, and computer-readable medium for stitching.

A first exemplary embodiment of the present disclosure provides a method for stitching. The method includes sensing, by a first sensor, a movement of a work piece relative to a sewing head and sensing, by a second sensor, a movement of the work piece relative to the sewing head. The method further includes determining, by a processor, a translational and rotational movement of the work piece relative to the sewing head based on the sensed movement of the first sensor and the second sensor and altering, by the processor, a speed of a reciprocating needle in response to the determined translational and rotational movement.

A second exemplary embodiment of the present disclosure provides an apparatus for stitching. The apparatus includes a sewing head including a reciprocating needle, a first and a second sensor for sensing a movement of a work piece relative to the sewing head, a memory including computer program instructions, and a processor. The sewing head including the reciprocating needle, the first sensor, the second sensor, the memory including computer program instructions and the processor are configured to cause the apparatus to at least sense, by the first sensor, a movement of the work piece relative to the sewing head. The apparatus is further configured to at least sense, by the second sensor, a movement of the work piece relative to the sewing head and determine, by the processor, a translational and rotational movement of the work piece relative to the sewing head based on the sensed movement of the first sensor and the second sensor. The apparatus is further configured to at least alter, by the processor, a speed of the reciprocating needle in response to the determined translational and rotational movement.

A third exemplary embodiment of the present disclosure provides a non-transitory computer-readable medium tangibly comprising computer program instructions which when executed on a processor of an apparatus causes the apparatus to at least sense, by a first sensor, a movement of a work piece relative to a sewing head. The computer-readable medium comprising computer program instructions and the processor further cause the apparatus to at least sense, by a second sensor, a movement of the work piece relative to the sewing head and determine, by the processor, a translational and rotational movement of the work piece relative to the sewing head based on the sensed movement of the first sensor and the second sensor. The computer-readable medium comprising computer program instructions and the processor further cause the apparatus to at least alter, by the processor, a speed of a reciprocating needle in response to the determined translational and rotational movement.

The following will describe embodiments of the present invention, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

Figure 5A:
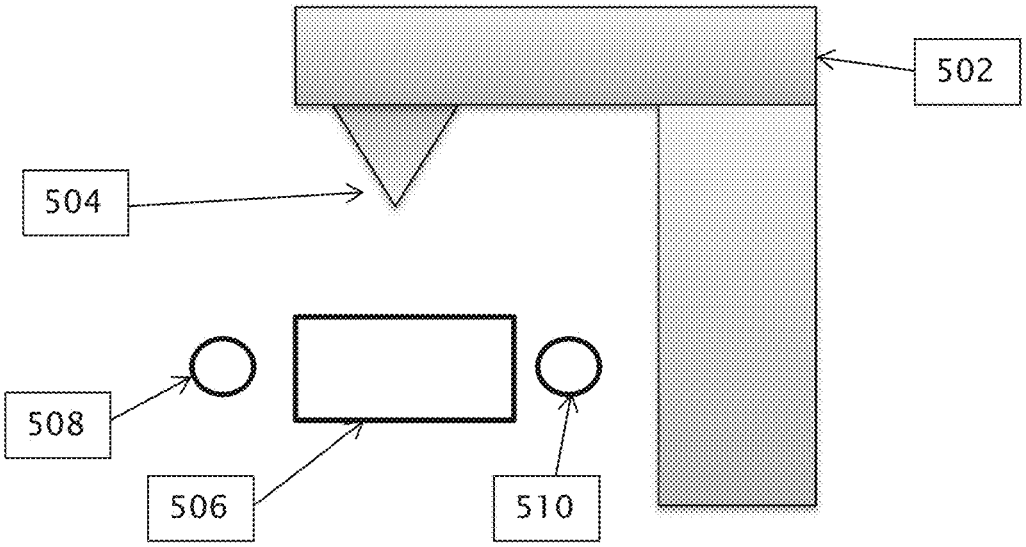

FIG. 5*a* is a close up view of another configuration of a device suitable for practicing exemplary embodiments of this disclosure.

Figure 5B:
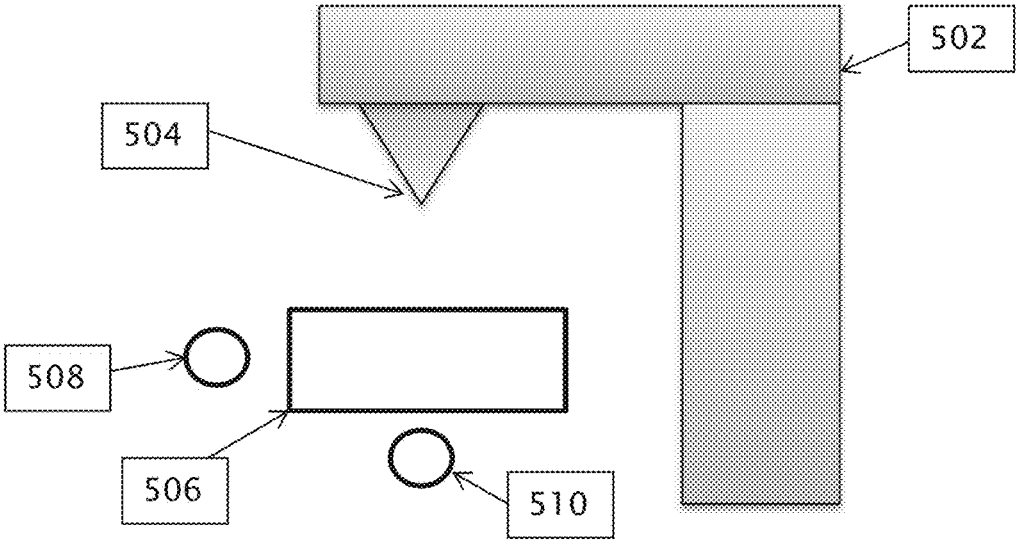

FIG. 5*b* is a close up view of another configuration of a device suitable for practicing exemplary embodiments of this disclosure.

DETAILED DESCRIPTION OF THE INVENTION

In free motion quilting, the location as well as the movement of the needle relative to a location on a work piece is determined by a user. That is, the user moves the sewing head of the quilting machine in whichever direction they please to create the pattern in the quilt. Hence, each stitch in free motion quilting is determined by the user and not preprogrammed by a computer. One difficulty that arises during free motion quilting is the ability to maintain a uniform stitch length while the user moves the sewing head or the work piece in multiple directions and at different speeds.

One solution that overcomes this difficulty is for the reciprocating speed of the needle to remain constant as the user moves the sewing head or the work piece at a continuous constant rate. This solution however, still leaves open the likely possibility that the user will move the sewing head or the fabric at different speeds and thus create different stitch lengths. Therefore, rather than rely on the user to move the sewing head or the fabric at a continuous constant rate, it is ideal to provide a way to accurately track the movement of the sewing head or the quilt and modify the reciprocating speed of the needle in response to the tracked movement.

Some quilting machine manufacturers have developed quilting machines that use a sensor to observe the translational velocity of the sewing head or the quilt and in turn controls the stitching motor speed as needed. Yet, this solution still falls short of providing a complete answer because they are not able to monitor both translational and rotational movement. Exemplary embodiments of the present disclosure allow for the reciprocating speed of a needle to be adjusted or modified based on both the translational and rotational movement of a sewing head relative to a work piece or the work piece relative to the sewing head.

Exemplary embodiments of the present disclosure provide for a quilting or sewing machine that has a two photo sensor mechanism. The two photo sensor mechanism can be located on the head of the quilting or sewing machine or underneath the work piece or fabric that is laid out underneath the sewing head of the quilting machine or sewing machine. The two photo sensors stream position data of the work piece or fabric to a sensor controller or processor. The sensor controller or processor manipulates the data to account for translational and rotational movement as well as to account for misreading or missensing by one of the sensors. Once the rotations and misreads are accounted for, the sensor controller or processor creates two simulated encoder outputs to represent movement in X and Y Cartesian coordinates. XA/XB are the equivalent X encoder signals and YA/YB are the equivalent Y encoder signals. These signals are provided to the controller that is operating the sewing head or needle position to maintain uniform stitch length.

These two sets of channels allow either the internal or the external processor to determine an array of information. First, the channels provide a means to detect position of the work piece relative to the needle or the position of the needle relative to the work piece as opposed to the position of the needle in a reciprocating cycle. The total number of output pulses in the X and Y direction are recorded. The two channels allow the external or internal processors to add or subtract position values. The total sum of pulses in the X and Y direction from the encoder multiplied by a calibration factor gives the relative position of the sensed work piece or fabric. The calibration factor is a value equal to pulses per linear distance for the given system. Since the pulses XA/XB and YA/YB are outputs created from the reading of the sensors, the frequency of the pulses is controlled by how fast the work piece is moved over the sensors.

Second, the channels provide a means to detect the velocity of the sewing head or the work piece. The sensor controller which includes a processor using the Pythagorean Theorem can manipulate data pulses of the two photo sensors containing movement in the X and Y direction. A sample of the pulses for the X and Y direction are taken over a small period of time. The square root of the sum of the squares of the total pulses in the X direction and the total pulses in the Y direction multiplied by the calibration factor gives a linear distance. The linear distance is divided by the period of time in which the sample pulses were taken. This value is the velocity of the sensed product over the period of time. It should be noted that in order to detect velocity, it is not necessary to be able to detect position. In other words, all data pulses, XA/XB and YA/YB, are additions. Only a consistent stream of pulses that varies based on motion of the product is needed.

In other exemplary embodiments, these two sets of channels allow other computer systems to manipulate the data in other ways. For instance, the position data can be calculated and tracked on a Cartesian coordinate system to maintain a cursor position on a screen. In this example, the movement information of the work piece relative to the needle would be tracked. Based on the tracked movement, a cursor on a screen would move proportionally in the same direction and speed as to the sensed movement of the work piece.

Figure 1:
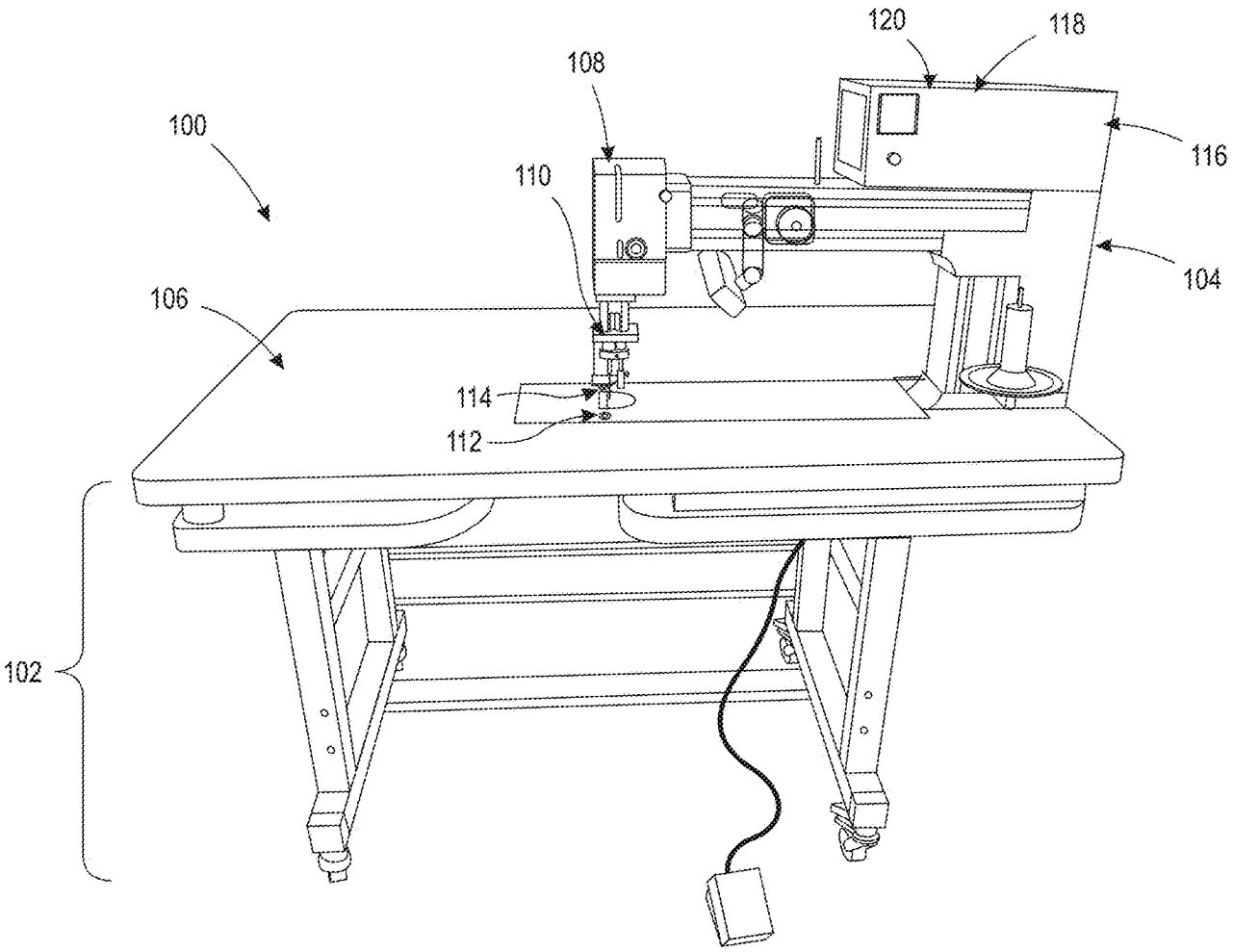
FIG. 1 is a perspective view of a configuration of a device suitable for use in practicing exemplary embodiments of this disclosure.

Referring to FIG. 1, provided is a perspective view of a quilting machine 100 suitable for use in practicing exemplary embodiments of the present disclosure. It can be appreciated that embodiments of the present disclosure are not limited to the particular configurations of quilting machine 100.

The term quilting machine 100 incorporates any device for the stitching or embroidery of a work piece or fabric. The term quilting machine 100 also includes quilting machines able to stitch together multiple layers, such as a filler layer between a top and bottom textile layer, as well as an embroidery machine.

The term work piece or fabric incorporates any article of manufacture or fabric made by weaving, felting, knitting, crocheting, compressing natural or synthetic fibers. In one configuration, a work piece or fabric is a quilt. In the construction of a quilt, it is common to refer to or identify a quilt block. A quilt block is a small part of a quilt top. A number of quilt blocks together make a quilt. The blocks can be the same, or different from each other. Quilt blocks can be pieced or appliqued or represent a given portion of the quilt.

Quilting machine 100 includes a support frame 102, a sewing machine 104, table top 106 for supporting or retaining a work piece or fabric, a sewing head 108, a reciprocating needle 110, a first sensor 112, a second sensor 114, and a motor 116. Quilting machine 100 further includes a controller 118 operably connected to the sewing head 108 and an encoder 120. The controller 118 can include a computer processor 122 (not shown) and memory 124 (not shown) for storing computer program instructions. The computer program instructions when executed on the computer processor 122 allow for quilting machine 100 to perform the operations described below.

The support frame 102 can be arranged in any variety of configurations. For example, the support frame 102 depicted in FIG. 1 can include struts or supports for engaging components described herein. The support frame 102 can be composed of any variety of materials or combinations of materials, such as metals, metal alloys, aluminum alloys, plastics, composites or wood.

Sewing machine 104 includes sewing head 108 having a portion above table top 106 and a second portion below or within table top 106. A passage is provided in table top 106 such that a portion of the reciprocating needle 110 can pass through a work piece or fabric placed on top of table top 106 and selectively engaging the passage of a length of thread through the work piece or fabric.

Table top 106 provides a flat surface area for a work piece or fabric to be placed while sewing machine 104 is sewing or operating on the work piece or fabric.

Sewing head 108 includes reciprocating needle 110. Exemplary embodiments of reciprocating needle 110 provide that it can operably move in an up and down motion such that a portion of reciprocating needle 110 can pierce a work piece or fabric that lies on table top 106.

First sensor 112 and second sensor 114 are located on table top 106 and are optimally located on opposite sides of the drop location of the reciprocating needle 110. The first sensor 112 and the second sensor 114 in exemplary embodiments can be optical sensors, motion sensors or any type of sensor capable of monitoring the movement of the work piece relative to the sewing head 108. An optical sensor operates by using a tiny camera that takes upward of 1,500 pictures every second. The images are compared with one another such that over a sequence of images it can be determined when movement occurs. An exemplary optical sensor in the marketplace is found in a commercially sold optical mouse for a computer. In other exemplary embodiments of quilting machine 100, the first sensor 112 and the second sensor 114 are located on sewing head 108 such that they can monitor the movement of the work piece relative to the sewing head 108. Thus the sensors may be located below the work piece or above the work piece.

The controller 118 can include a display and input, such as a touch screen, keyboard, keypad, and/or mouse. The controller 118 can be physically connected to the main frame 102 or the sewing machine 104. Alternatively, the controller 118 can be a stand-alone device, which communicates with the sewing machine 104 and the encoder 120 through a wired or wireless connection.

Although the present disclosure is set forth in terms of a quilting machine 100 that has a stationary sewing head and a work piece that is moved during stitching, it is understood that the sewing head 108 can move relative to a fixed work piece. Alternatively, both the sewing head 108 and work piece can be simultaneously moved.

Encoder 120 is operably able to communicate with the controller 118 as well as computer processor 122 and memory 124. Encoder 120 receives the movement information determined by the computer processor 122 and memory 124. Encoder 120 then translates or converts the movement information into a format readable by motor 116, such that motor 116 operates reciprocating needle 110 in a manner that maintains a uniform stitch length.

In one exemplary embodiment as the work piece is moved along table top 106 relative to sewing head 108, the first sensor 112 and the second sensor 114 sense the direction and speed of the movement of the work piece. This data is communicated to the encoder 120, the computer processor 122, and memory 124. The speed and direction of movement of the work piece is determined by the computer processor 122. Encoder 120 then converts the movement information determined by the computer processor 122 into a format readable by motor 116, which then directs the motor 116 to operate at a certain rate controlling the up and down speed of reciprocating needle 110. That is, motor 116 drives the cycle frequency of the reciprocating needle 110. In order to provide a uniform stitch length, as the velocity of the work piece relative to sewing machine 106 is increased so is the speed of motor 116 and the cycle frequency of reciprocating needle 110. Likewise, as the velocity and distance moved of the work piece is decreased so is the speed of motor 116 and the cycle frequency of the reciprocating needle 110.

In another exemplary embodiment the work piece could be rotated about an axis that aligns either on or more closely to the first sensor or the second sensor. In this instance, the sensor that is located either close to or at the center of the axis of rotation will not sense that there is any movement by the work piece or sense less movement of the work piece than the other sensor. The other sensor will be able to sense the movement of the work piece. The encoder 120, the computer processor 122, and memory 124 will determine based on the difference between the information received from the first sensor and the second sensor the rate of rotation of the work piece and adjust the speed of the motor 116 and the reciprocating needle 110 accordingly in order to maintain a uniform stitch length. This will be performed by the computer processor 122 continuously comparing the data received from the two sensors. The data received from the two sensors will be added together to produce an improved response to the movement of the work piece. If the sum of the sensed movement of the two sensors is a positive or negative number then it is known that the work piece is moving in one linear direction. If the sensed movement is in opposite directions because of rotation of the work piece, the sum of the two sensors will cancel each other out.

In yet another exemplary embodiment, if a work piece is rotating and moving translationally relative to the sewing head, one of the two sensors may misread or missense some or all of the movement of the work piece. In this instance, the encoder 120, the computer processor 122, and memory 124 will receive correct information from one of the sensors and the other sensor will either not send any information or will send information that is incorrect. The encoder 120, the computer processor 122, and memory 124 will adjust the information from the sensor that either provides no information or incorrect information in conjunction with the information from the sensor that is sensing correctly to create correct movement information of the work piece. One exemplary embodiment of this process begins with the computer processor 122 detecting that one of the sensors is either no longer sending movement information or updating with invalid movement information. The computer processor 122 will then assume that the sensor is no longer sensing the work piece and will double the information from the sensor still providing information. The processor 122 through encoder 120 will then communicate with motor 116 and adjust the reciprocating speed of the reciprocating needle 110 to produce a uniform stitch length.

Figure 2:
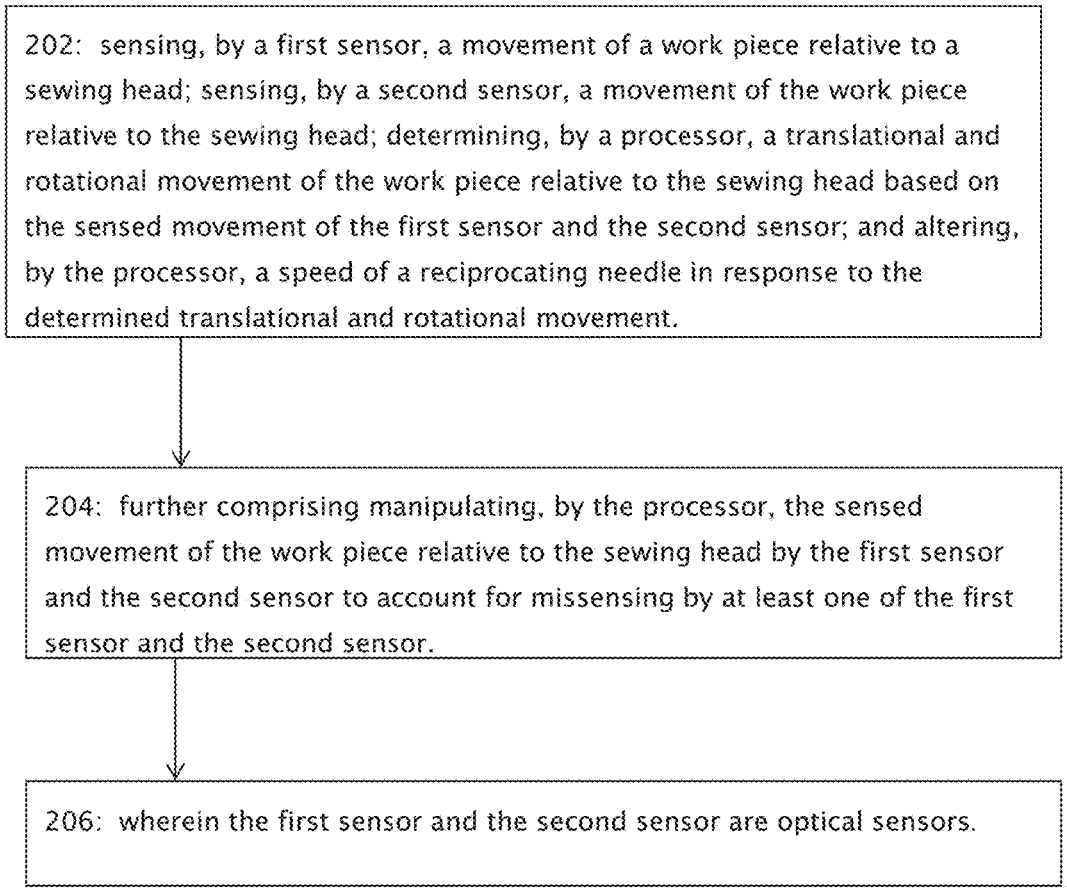
FIG. 2 is a logic flow diagram in accordance with a method, apparatus, and computer-readable medium for performing exemplary embodiments of this disclosure.

FIG. 2 presents a summary of the above teachings for stitching. Block 202 presents sensing, by a first sensor, a movement of a work piece relative to a sewing head; sensing, by a second sensor, a movement of the work piece relative to the sewing head; determining, by a processor, a translational and rotational movement of the work piece relative to the sewing head based on the sensed movement of the first sensor and the second sensor; and altering, by the processor, a speed of a reciprocating needle in response to the determined translational and rotational movement. Then block 204 specifies further comprising manipulating, by the processor, the sensed movement of the work piece relative to the sewing head by the first sensor and the second sensor to account for missensing by at least one of the first sensor and the second sensor.

Some of the non-limiting implementations detailed above are also summarized at FIG. 2 following block 204. Block 206 relates to wherein the first sensor and the second sensor are optical sensors. The present system thus varies the cycle frequency of the reciprocating needle corresponding to the user imparted velocity, distance and rotation moved of the work piece relative to the sewing head. In other exemplary embodiments, the present system can vary the cycle frequency of the reciprocating needle corresponding to the user imparted velocity, distance and rotation moved of the sewing head relative to the work piece.

The logic diagram of FIG. 2 may be considered to illustrate the operation of a method, a result of execution of computer program instructions stored in a computer-readable medium. The logic diagram of FIG. 2 may also be considered a specific manner in which components of the device are configured to cause that device to operate, whether such a device is a quilting machine or some other device, or one or more components thereof. The various blocks shown in FIG. 2 may also be considered as a plurality of coupled logic circuit elements constructed to carry out the associated function(s), or specific result of strings of computer program instructions or code stored in a memory.

Various embodiments of the computer-readable medium include any data storage technology type which is suitable to the local technical environment, including but not limited to semiconductor based memory devices, magnetic memory devices and systems, optical memory devices and systems, fixed memory, removable memory, disc memory, flash memory, dynamic random-access memory (DRAM), static random-access memory (SRAM), electronically erasable programmable read-only memory (EEPROM) and the like. Various embodiments of the processor include but are not limited to general purpose computers, special purpose computers, microprocessors, digital signal processors and multicore processors.

Figure 3:
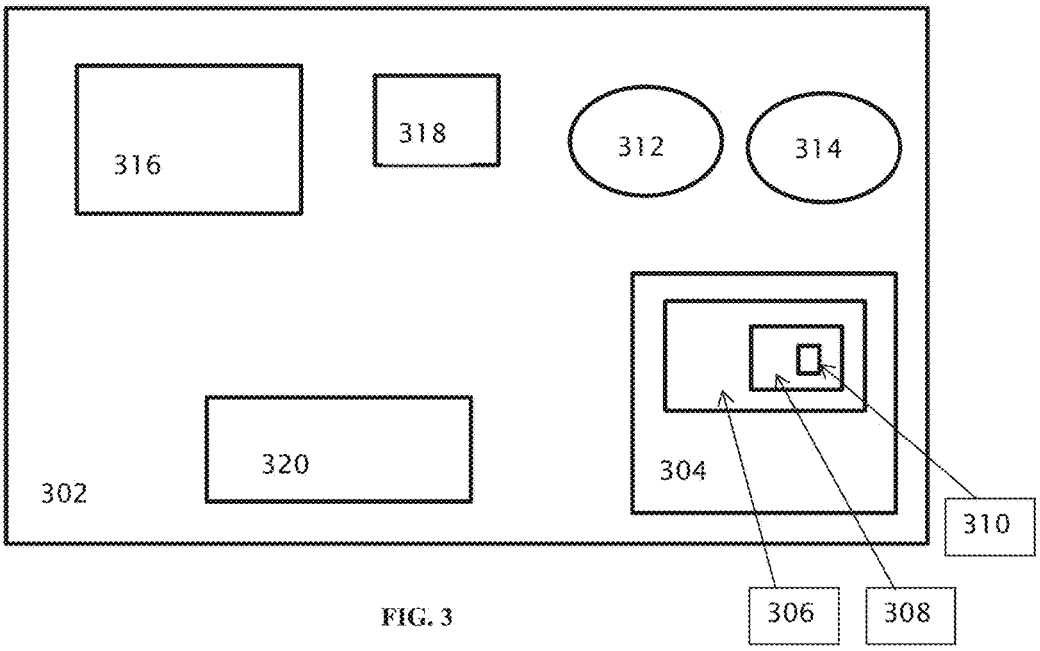
FIG. 3 is a simplified block diagram of a device suitable for use in practicing exemplary embodiments of this disclosure.

Reference is now made to FIG. 3 for illustrating a simplified block diagram of the various elements of a device suitable for use in practicing the exemplary embodiments of this disclosure. In FIG. 3, device 302 is adapted for stitching a work piece. Device 302 may be any quilting or sewing machine or device suitable for stitching together two or more pieces of fabric.

Device 302 includes processing means such as a controller 304 which includes at least one data processor 306, storing means such as at least one computer-readable memory 308 storing at least one computer program 310. Controller 304, the at least one data processor 306, and the at least one computer-readable memory 308 with the at least one computer program 310 provide a mechanism to interpret and determine the movement of a work piece. The device 302 also includes sensor 312 and sensor 314 for sensing the movement of the work piece. Sensors 312 and 314 are operably connected to controller 304 such that sensors 312 and 314 are able to transmit their sensor information to controller 304 and data processor 306. Device 302 further includes motor 316 operably connected to controller 304 and reciprocating needle 318. Reciprocating needle 318 is operably connected to controller 304. The cycle frequency of reciprocating needle 318 is controlled by motor 316, which is in turn determined by controller 304.

Device 302 also includes encoder 320 to encode the sensed movement information determined by the data processor 306 such that it can be read by motor 316. Encoder 320 is operably connected to sensors 312 and 314 as well as controller 304, data processor 306, and motor 316. Device 302 includes an operational on/off switch 320 for selectively operating controller 304, motor 316, sensors 312 and 314, reciprocating needle 318, and encoder 320. In some exemplary embodiments, on/off switch 320 is a foot pedal that can be pressed to operate device 302. In other exemplary embodiments, on/off switch 320 is a physical switch located on device 302 that can be operated by hand.

The at least one of computer program 310 in device 320 in exemplary embodiments is a set of program instructions that, when executed by the associated data processor 306, enable the device 302 to operate in accordance with the exemplary embodiments of this disclosure, as detailed above. In these regards, the exemplary embodiments of this disclosure may be implemented at least in part by a computer software stored in computer-readable memory 308, which is executable by the data processor 306. Devices implementing these aspects of the disclosure need not be the entire device as depicted in FIG. 3 or may be one or more components of same such as the above described tangibly stored software, hardware, and data processor.

Figure 4:
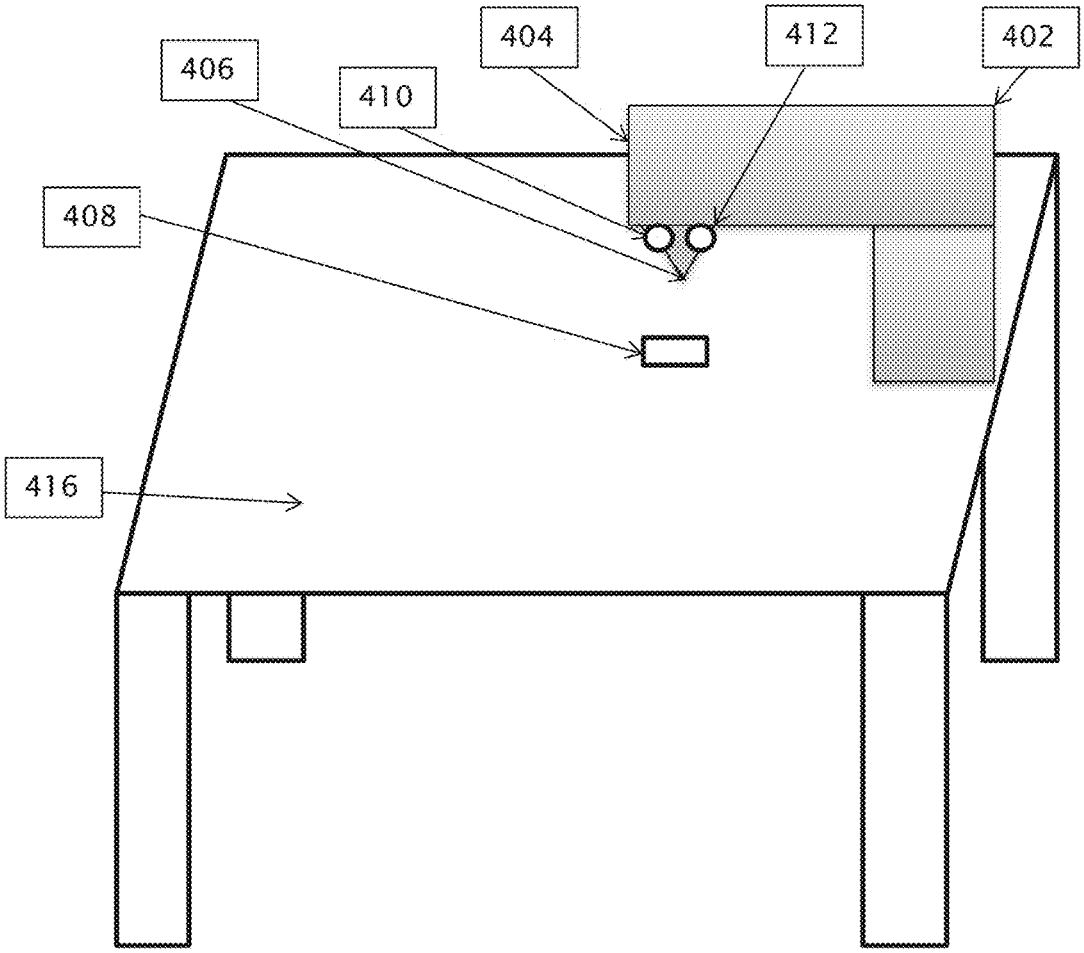
FIG. 4 is a perspective view of an alternative configuration of a device suitable for practicing exemplary embodiments of this disclosure.

Referring to FIG. 4, provided is an alternative arrangement of a device suitable for practicing exemplary embodiments of this disclosure. FIG. 4 provides a device 402 for quilting or sewing. Device 402 includes a sewing head 404 with reciprocating needle 406. Reciprocating needle 406 is operable to move in an up and down motion. Device 402 is stationary and maintained on table 416. Within table 416 and underneath reciprocating needle 406 is space 408. Space 408 provides an opening such that when reciprocating needle 406 is in a fully extended down position, reciprocating needle 406 does not touch table 416.

FIG. 4 also provides sensors 410 and 412 for sensing movement of a work piece that are placed on sewing head 404. Sensors 410 and 412 are stationary and in this embodiment are located on either side of reciprocating needle 406. It should be appreciated that sensors 410 and 412 can be located in many different arrangements with respect to reciprocating needle 406. Ideally, sensors 410 and 412 are located on opposite sides of reciprocating needle 406. Sensors 410 and 412 in exemplary embodiments are optical sensors, motion sensors or any type of sensor capable of monitoring the movement of a work piece relative to the sewing head 404. The sensed movement from sensors 410 and 412 is communicated either through a wired or wireless connection to a controller (not shown), a processor (not shown), and an encoder (not shown). The processor in conjunction with the encoder determines the movement of the work piece and operates a motor that controls that cycle frequency of reciprocating needle 406 in order to create a uniform stitch length.

Exemplary embodiments of the configuration provided in FIG. 4 include different arrangements of sensors 410 and 412 relative to reciprocating needle 406. Sensors 410 and 412 are preferably located on opposite sides of reciprocating needle 406 and relatively close to reciprocating needle 406. While sewing or quilting, the area of a work piece immediately surrounding the drop location of reciprocating needle 406, which is within space 408 typically, has an increased tension when compared to other areas of the work piece. This increased tension helps prevent the possibility of the work piece folding on itself and the reciprocating needle 406 from stitching two portions of the work piece together that were not meant to be sewn together. Additionally, the increased tension helps in the creation of a uniform stitch length.

Due to this increased tension in the work piece, it is preferred that sensors 410 and 412 be relatively close to the drop location of reciprocating needle 406 and within the area of tension of the work piece. Since the area of tension of the work piece is in most cases the flattest and most uniform area of the work piece, this area is also the portion of the work piece that will provide the most accurate data for sensing movement. It can also be appreciated that sensors 410 and 412 are preferably spaced a given distance from one another such that when the work piece is rotated about an axis that aligns with one of the two sensors, the other sensor is able to sense the movement of the work piece. If sensors 410 and 412 are located too closely to one another, neither sensor will be able to detect any movement even though the work piece is in fact rotating. This is true for whether the sensors are located on the sewing head 404 or on table 416.

FIG. 5*a* provides an alternative configuration of a device suitable for practicing exemplary embodiments of this disclosure. FIG. 5*a* illustrates a sewing or quilting machine 502 with reciprocating needle 504, space 506, and two sensors 508 and 510. Reciprocating needle 504 is operably able to move up and down. Space 506 provides an opening in the surface of the table to which sewing or quilting machine 502 is affixed. Space 506 also provides an opening for reciprocating needle 504 to extend into when it is in the fully extended in the down position. In this embodiment, sensors 508 and 510 for sensing movement of a work piece are located on opposite sides of spacer 506 and align with the body of sewing or quilting machine 502.

FIG. 5*b* provides another alternative configuration of a device suitable for practicing exemplary embodiments of this disclosure. FIG. 5*b* again illustrates sewing or quilting machine 502 with reciprocating needle 504, space 506, and two sensors 508 and 510. Reciprocating needle 504 is operably able to move up and down. Space 506 provides an opening in the surface of the table that sewing or quilting machine 502 rests. Space 506 also provides an opening for reciprocating needle 504 to extend into when it is in the down position. In this embodiment, sensors 508 and 510 for sensing movement are located on adjacent sides of space 506. It can be appreciated that sensors 508 and 510 can be located in many different arrangements and variations without departing from the basic principles described above.

What is claimed is:

1. A method of stitching, the method comprising:

(a) sensing, by a first sensor, a movement of a work piece relative to a sewing head;

(b) sensing, by a second sensor, a movement of the work piece relative to the sewing head;

(c) detecting, by a processor, that the second sensor is one of (i) not sensing movement of the work piece, and (ii) sensing invalid movement of the work piece;

(d) determining, by the processor, a translational and rotational movement of the work piece relative to the sewing head based on the sensed movement of the first sensor; and (d) altering, by the processor, a speed of a reciprocating needle in response to the determined translational and rotational movement.

2. The method according to claim 1, wherein the determining comprises associating the sensed movement of the work piece by the first sensor for both the first sensor and the second sensor.

3. The method according to claim 2, wherein the first sensor and the second sensor are optical sensors.

4. An apparatus for stitching, the apparatus comprising:

a sewing head including a reciprocating needle;

a first and a second sensor for sensing a movement of a work piece relative to the sewing head;

a memory including computer program instructions; and a processor, wherein the sewing head including the reciprocating needle, the first sensor, the second sensor, the memory and the processor are configured to cause the apparatus to at least:

sense, by the first sensor, a movement of a work piece relative to the sewing head;

sense, by the second sensor, a movement of the work piece relative to the sewing head;

detect that the second sensor is one of (i) not sensing movement of the work piece, and (ii) sensing invalid movement of the work piece;

determine, by the processor, a translational and rotational movement of the work piece relative to the sewing head based on the sensed movement of the first sensor; and alter, by the processor, a speed of a reciprocating needle in response to the determined translational and rotational movement.

5. The apparatus according to claim 4, wherein the determining comprises associating the sensed movement of the work piece by the first sensor for both the first sensor and the second sensor.

6. The apparatus according to claim 5, wherein the first sensor and the second sensor are optical sensors.

7. A non-transitory computer-readable medium tangibly comprising computer program instructions which when executed on a processor of an apparatus causes the apparatus to at least:

sense, by a first sensor, a movement of a work piece relative to a sewing head;

sense, by a second sensor, a movement of the work piece relative to the sewing head;

detect that the second sensor is one of (i) not sensing movement of the work piece, and (ii) sensing invalid movement of the work piece;

determine, by the processor, a translational and a rotational movement of the work piece relative to the sewing head based on the sensed movement of the first sensor and the second sensor; and alter, by the processor, a speed of a reciprocating needle in response to the determined translational and rotational movement.

8. The non-transitory computer-readable medium according to claim 7, wherein the determining comprises associating the sensed movement of the work piece by the first sensor for both the first sensor and the second sensor.

9. The non-transitory computer-readable medium according to claim 8, wherein the first sensor and the second sensor are optical sensors.

* * * * *